US006151469A

United States Patent [19]

Lee

[11] Patent Number: 6,151,469

[45] Date of Patent: Nov. 21, 2000

[54] INK DELIVERY SYSTEM FOR LIQUID ELECTROPHOTOGRAPHIC PRINTER

[75] Inventor: Hyong-Gu Lee, Kunpo, Rep. of Korea

[73] Assignee: SamSung Electronics Co., Ltd., Suwon, Rep. of Korea

[21] Appl. No.: 09/417,759

[22] Filed: Oct. 14, 1999

[30] Foreign Application Priority Data

Jan. 18, 1999 [KR] Rep. of Korea ..... 99-1248

[51] Int. Cl.[7] ..... G03G 15/10

[52] U.S. Cl. ..... 399/237; 399/360

[58] Field of Search ..... 399/237, 57, 120, 399/233, 238, 348, 360, 358

[56] References Cited

U.S. PATENT DOCUMENTS 5,933,689 8/1999 Kim ..... 399/233
6,011,943 1/2000 Kim ..... 399/238

*Primary Examiner*—Quana M. Grainger

*Attorney, Agent, or Firm*—Robert E. Bushnell, Esq.

[57] ABSTRACT

An ink delivery system for a liquid electrophotographic printer supplies developer of a predetermined concentration and comprising a mixture of ink and carrier to a development unit. A circulation tank receives and holds developer to be supplied to the development unit. An ink tank and a carrier tank included in a main body of the printer store ink of a predetermined color and carrier, respectively, for supply to the circulation tank. A refill cartridge refills ink/carrier through an ink/carrier supply path when ink or carrier in the ink tank and/or the carrier tank is used up. A refill cartridge installation unit, to which the refill cartridge is detachably installed, supplies the ink or carrier from the installed refill cartridge to the ink tank or the carrier tank, respectively. A waste tank connected to the circulation tank collects waste developer in the circulation tank. A waste refill cartridge installation unit is provided in the main body ofthe printer for connection to the waste tank, and an empty refill cartridge is detachably installed to the waste refill cartridge installation unit to receive waste developer.

15 Claims, 3 Drawing Sheets

INK DELIVERY SYSTEM FOR LIQUID ELECTROPHOTOGRAPHIC PRINTER

CLAIM OF PRIORITY

This application makes reference to, incorporates the same herein, and claims all benefits accruing under 35 U.S.C. §119 from my application INK DELIVERY SYSTEM FOR LIQUID ELECTROPHOTOGRAPHIC PRINTER filed with the Korean Industrial Property Office on Jan. 18, 1999 and there duly assigned Ser. No. 1248/1999.

BACKGROUND OF THE INVENTION

1. Technical Field

The present invention relates to an ink delivery system for a liquid electrophotographic printer and, more particularly, to an ink delivery system for a liquid electrophotographic printer having an improved structure in which a refillable cartridge, after being emptied, is connected to a waste tank to collect waste developer exhausted from the printer.

2. Related Art

In a liquid electrophotographic printer, a laser beam is directed by a laser scanning unit (LSU) onto a photoreceptor medium to form an electrostatic latent image thereon. Developer, which is a mixture of toner (or ink) and carrier, is injected between the photoreceptor medium and a development roller to develop the photoreceptor medium. A toner image developed on the photoreceptor medium is then transferred to a sheet of paper.

Such printers are burdened by certain disadvantages. Namely, when the ink or carrier cartridges become empty, those cartridges may not be used, and must be replaced. Moreover, the functional parts of such cartridge (e.g., the agitator) must be replaced. This is costly for the user/consumer, as well as time consuming, and has an adverse impact from the standpoint of environmental considerations (e.g., recycling).

In addition, in such printers, when the developer waste tank becomes full due to use, it must also be replaced. Since the waste tank is typically located under the circulation tank, the development unit and circulation tank must be removed in order to access and remove the waste tank. This is time-consuming and annoying for the user/consumer, and is also costly and wasteful (from the environmental standpoint).

SUMMARY OF THE INVENTION

To solve the above problems, it is an objective of the present invention to provide an ink delivery system for a liquid electrophotographic printer in which an ink tank and a carrier tank, including functional parts, are fixedly installed in the main body of the printer, and a refill cartridge is detachably installed in the main body of the printer, so that ink or carrier in the refill cartridge can be supplied to the corresponding ink tank or carrier tank, and also waste developer stored in a waste tank can be collected using a refill cartridge after it is emptied.

Accordingly, to achieve the above objective, there is provided an ink delivery system for a liquid electrophotographic printer for supplying developer (a mixture of toner or ink and carrier) of a predetermined concentration to a development unit. The system comprises: a circulation tank containing developer supplied to the development unit; an ink tank and a carrier tank included in a main body of the printer, the ink tank storing ink of a predetermined color and the carrier tank storing carrier, each of which is to be supplied to the circulation tank; a refill cartridge for refilling ink/carrier through an ink/carrier supply path when ink or carrier in the ink tank and/or the carrier tank is used up; a refill cartridge installation unit to which the refill cartridge is detachably installed for supplying ink or carrier from the installed refill cartridge to the ink tank or the carrier tank, respectively; a waste tank connected to the circulation tank to collect waste developer in the circulation tank; and a waste refill cartridge installation unit provided in the main body ofthe printer for connection to the waste tank, an empty refill cartridge being detachably installed to the unit.

In the present invention, the waste refill cartridge installation unit preferably comprises: a waste developer exhaustion path connected to the waste tank; and a waste developer exhaustion pump installed on the waste developer exhaustion path for exhausting the waste developer in the waste tank to the empty refill cartridge.

In a preferred embodiment of the present invention, the refill cartridge has a single entrance through which ink/carrier contained in the refill cartridge can be exhausted and waste developer can flow in, and the refill cartridge installation unit comprises a movable plate wherein injection holes of the ink/carrier supply path are installed, and a driving source for connecting the entrance and a selected injection hole by sliding or rotating the movable plate.

BRIEF DESCRIPTION OF THE DRAWINGS

A more complete appreciation ofthe invention, and may ofthe attendant advantages, thereof, will bereadily apparent as the same becomes better understoodby reference to the following detailed description when considered in conjunction with the accompanying drawings in which like reference symbols indicate the same or similar components, wherein.

DETAILED DESCRIPTION OF THE INVENTION

Figure 1:
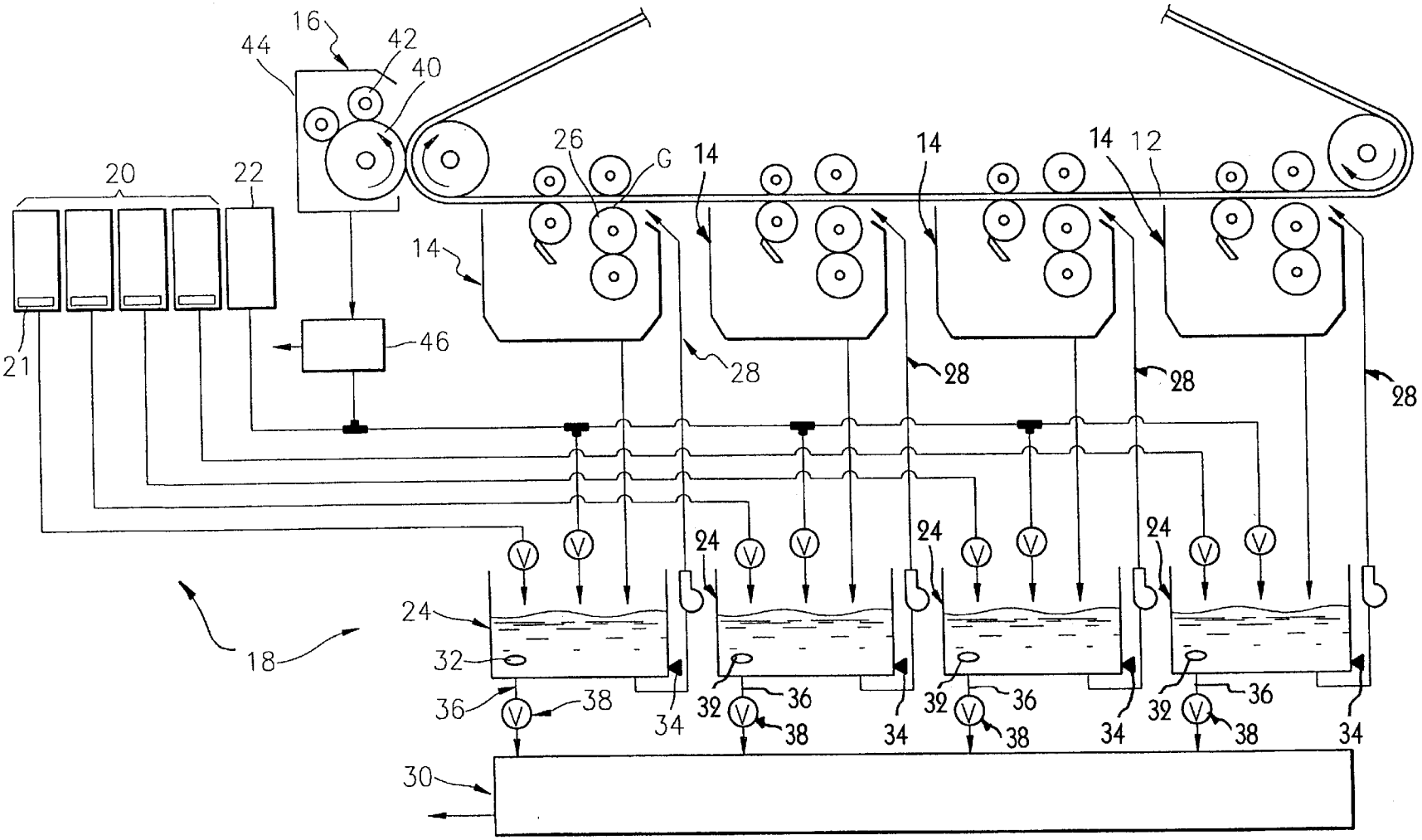
FIG. 1 is a view schematically showing the structure of an ink delivery system for a liquid electrophotographic printer.

FIG. 1 shows a liquid electrophotographic color printer. As shown in the drawing, a plurality of development units 14 is installed to develop an image corresponding to an electrostatic latent image formed on a photoreceptor medium 12 in the order of yellow, magenta, cyan, and black. A drying unit 16 is installed near the development unit 14 for black to dry the carrier remaining on the photoreceptor medium 12 after the development is completed. A plurality of circulation tanks 24, containing developer of a predetermined concentration and amount to be supplied to the development units 14, is provided. The carrier in the circulation tanks 24 includes the carrier collected from the drying unit 16.

An ink delivery system 18 includes: ink cartridges 20 containing concentrated ink; a carrier cartridge 22 containing carrier; and the circulation tanks 24 connected to the ink cartridge 20, the carrier cartridge 22 and the development units 14, respectively. The ink delivery system 18 also includes a plurality of injection paths 28 for injecting the developer in the circulation tanks 24 into a development gap G between a development roller 26 of each of the development units 14 and the photoreceptor medium 12, and a waste tank 30 connected to the circulation tank 24 to collect waste developer from the circulation tank 24.

The ink cartridges 20 and the carrier cartridge 22 are consumable parts which are replaced when the concentrated ink or carrier has been completely consumed. An agitator 21 for agitating the concentrated ink is installed in each ink cartridge 20.

A circulation tank 24 is installed under each of the development units 14. The developer supplied to development gaps G via injection paths 28, and remaining in the development units 14 after being used for development, is recollected in the circulation tank 24. Thus, the developer circulates between the circulation tank 24 and the development units 14 while being used for development unless the concentration and amount of the developer changes. Since the developer becomes contaminated as development continues, the waste developer in the circulation tank 24 is collected in the waste tank 30. Clean, new ink and carrier are supplied from the ink cartridges 20 and the carrier cartridge 22, respectively. A concentration sensor 32 and a level sensor 34 for detecting the concentration and level, respectively, ofthe developer contained in the circulation tanks 24 are installed in each circulation tank 24.

The waste tank 30 is located under the circulation tanks 24 and is connected thereto by a plurality of waste developer collection paths 36. Valves 38, which are selectively opened or shut by a contamination sensor (not shown), are installed on each of the waste developer collection paths 36. When the valve 38 is open, the waste developer in the circulation tanks 24 moves under its own weight so as to be collected in the waste tank 30.

The drying unit 16 includes a drying roller 40 for absorbing carrier remaining on the photoreceptor medium 12, a regeneration roller 42 rotating in contact with the drying roller 40 while heating the drying roller 40 so as to turn the carrier existing on the surface ofthe drying roller 40 into vapor, and a condenser 44 for condensing the carrier in a vapor state. The carrier condensed by the condenser 44 is temporarily stored in a condensation tank 46, and the carrier in the condensation tank 46 can be supplied to the circulation tanks 24.

In the ink delivery system of the liquid electrophotographic printer having the above structure, when ink or carrier in any of the ink cartridges 20 or the carrier cartridge 22 is totally consumed, the cartridges 20 or 22 must be replaced with a new cartridge. In the ink cartridges 20, a functional part such as the agitator 21 is also replaced so that the cost of the ink cartridges 20 increases. Also, when the waste tank 30 is required to be replaced as the waste developer stored in the waste tank 30 increases, since the waste tank 30 is located under the circulation tanks 24, the development units 14 and the circulation tanks 24 must be disassembled prior to replacement. Thus, the job of replacing the waste tank 30 is inconvenient, and the main body of the printer may be contaminated by waste developer during replacement.

Figure 2:
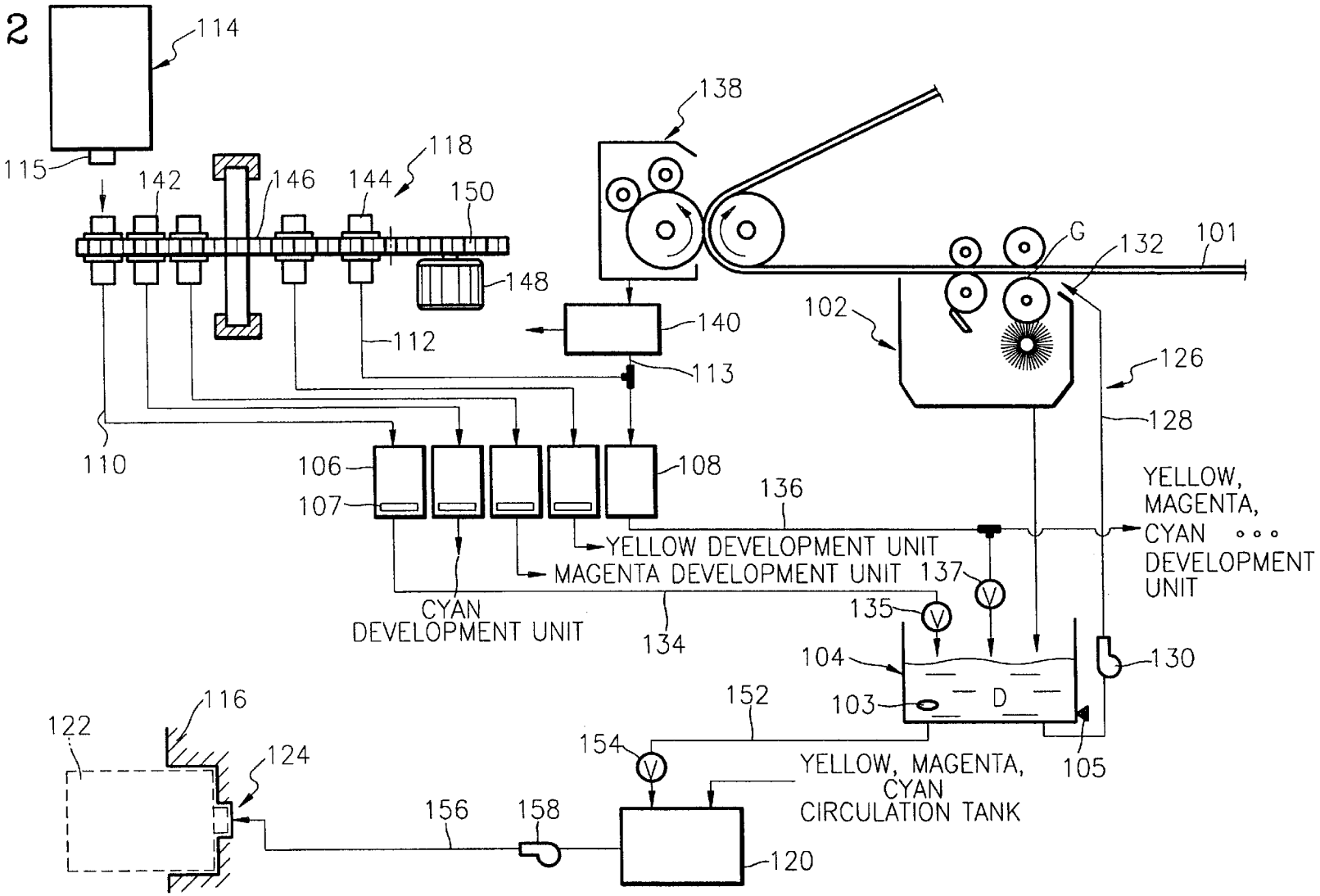
FIG. 2 is a view schematically showing the structure of an ink delivery system for a liquid electrophotographic printer according to a preferred embodiment of the present invention.

Referring to FIG. 2, an ink delivery system for a liquid electrophotographic printer according to a preferred embodiment of the present invention includes: a circulation tank 104 containing developer which is supplied to a development unit 102 of the corresponding color; an ink tank 106 containing concentrated ink of a predetermined color supplied to the circulation tank 104; and a carrier tank 108 containing carrier which is supplied to the circulation tank 104. The ink tank 106 and the carrier tank 108 are provided with concentrated ink and carrier, respectively, from a refill cartridge 114 via an ink supply path 110 and a carrier supply path 112, respectively. The refill cartridge 114 can be installed at, and detached from, a refill cartridge installation unit 118 disposed on the upper portion of a main body 116 of the printer. The waste developer in the circulation tank 104 is collected in a waste tank 120. To drain the waste developer in the waste tank 120 into an empty waste refill cartridge 122, a waste refill cartridge installation unit 124 is installed at the outer surface of the main body 116.

The above ink delivery system also includes an injection portion 126 for injecting developer from the circulation tank 104 into a development gap G of the development unit 102. A plurality of paths provides connections between the above-described development unit 102, the circulation tank 104, the ink tank 106, the carrier tank 108, the refill cartridge 114, and the waste tank 120.

The circulation tank 104 is installed under the development unit 102. Developer is supplied to the development gap G via the injection portion 126, and the developer remaining in the development unit 102, after being used for development, is recollected in the circulation tank 104. Thus, the developer continuously circulates between the circulation tank 104 and the development unit 102 unless the concentration and amount of the developer changes. A concentration sensor 103 and a level sensor 105 for detecting the concentration and level, respectively, of the developer stored in the circulation tank 104 are installed at the circulation tank 104.

The injection portion 126 comprises an injection path 128 through which developer passes, a pump 130 installed on the injection path 128 for pumping the developer, and a nozzle 132 installed at one end of the injection path 128 for injecting the developer into the development gap G.

The ink tank 106 is fixedly installed in the main body 116 of the printer and is connected to the circulation tank 104 by a first supply path 134. The ink tank 106 can be provided with concentrated ink from the refill cartridge 114 through the ink supply path 110. An agitator 107 for agitating concentrated ink is installed in the ink tank 106.

The carrier tank 108 is fixedly installed in the main body 116 of the printer, and is connected to the circulation tank 104 by a second supply path 136. The carrier tank 108 can be provided with carrier stored in the refill cartridge 114 through the carrier supply path 112.

Valves 135 and 137, which are selectively opened and shut, are installed on the first and second supply paths 134 and 136, respectively. When the valves 135 and 137 are opened, the concentrated ink and the carrier stored in the ink tank 106 and the carrier tank 108, respectively, are supplied to the corresponding circulation tank 104 due to movement under their own weight. The carrier, dried and condensed by the drying unit 138 and collected in a condensation tank 140, can be supplied to the carrier tank 108 through a path 113 connected to the carrier supply path 112.

The refill cartridge 114 is divided into a refill cartridge for ink, which refills the ink tank 106 with concentrated ink via the ink supply path 110, and a refill cartridge for carrier, which refills the carrier tank 108 with carrier via the carrier supply path 112. Also, the refill cartridge for ink can be classified according to color such as yellow, magenta, cyan, and black. In this case, it is preferable that a cartridge/color identifying means (not shown) is used to discern the refill cartridge for ink from the refill cartridge for carrier, and identifying the color of the refill cartridge for ink. The cartridge/color identifying means is for identifying the type of refill cartridge 114 and connecting the refill cartridge 114 to the corresponding carrier supply path 112 or the ink supply path 110.

The refill cartridge 114 is not provided with a functional part such as an agitator, and is installed at the refill cartridge installation unit 118 only when ink or carrier is supplied. The waste refill cartridge 122, emptied after being used, and used to supplement the ink or carrier, can be installed at the waste refill cartridge installation unit 124 to collect the waste developer. For this purpose, a single entrance 115 is provided at the refill cartridge 114. The entrance 115 functions as an outlet through which the concentrated ink or carrier is exhausted to the ink tank 106 or the carrier tank 108, respectively, when the refill cartridge 114 is installed at the refill cartridge installation unit 118. The entrance 115 also functions as an inlet through which the waste developer in the waste tank 120 enters when the refill cartridge 114 is installed at the waste refill installation unit 124.

The refill cartridge installation unit 118 provides the concentrated ink or carrier in the installed refill cartridge 114 to the corresponding ink tank 106 or the carrier tank 108. For this purpose, the refill cartridge installation unit 118 includes a movable plate, such as rotary plate 146, in which ink inj ection holes 142 and a carrier injection hole 144 connected to the leading ends of the ink supply path 110 and the carrier supply path 112, respectively, are arranged at predetermined positions so as to be capable of rotating with respect to the main body 116 of the printer. A driving source 148 for rotating the rotary plate 146 is also provided in unit 118. The rotary plate 146 is installed so as to be capable of rotating around the center thereof, and has a geared portion at the outer circumferential surface thereof. Thus, the refill cartridge installation unit 118 can register the entrance 115 of the refill cartridge 114 with the ink injection hole 142 or the carrier injection hole 144, respectively, by rotation of the rotary plate 146.

The waste tank 120 is provided for collecting waste developer when the developer circulating between the circulation tank 104 and the development unit 102 is contaminated. The waste tank 120 is connected to the circulation tank 104 by a waste developer collection path 152, on which there is installed a valve 154 which is selectively opened or shut by a contamination detection sensor (not shown). When the valve 154 is open, the waste developer in the circulation tank 104 is collected in the waste tank 120 by movement under its own weight.

The waste refill cartridge installation unit 124, at which the empty waste refill cartridge 122 is installed, includes a waste developer exhaustion path 156 connected to the waste tank 120, and a waste developer exhaustion pump 158 installed on the waste developer exhaustion path 156 for exhausting the waste developer in the waste tank 120 to the waste refill cartridge 122.

Further referring to FIG. 2, during operation of the ink delivery system for a liquid electrophotographic printer having the above structure, the developer in the circulation tank 104 is injected into the development gap G of the development unit 102 through the injection portion 126 in a developing mode. The injected developer is used for development of an electrostatic latent image area of a photoreceptor medium 101. In doing so, the concentration sensor 103 and the level sensor 105 installed in the circulation tank 104 detect the concentration and amount, respectively, of the developer remaining in the circulation tank 104. When the concentration and amount of the developer in the circulation tank 104 are determined to be outside predetermined allowable ranges, the concentrated ink or carrier in the ink tank 106 or the carrier tank 108, respectively, is supplied to the circulation tank 104 through the first supply path 134 or second supply path 136, respectively.

When the ink tank 106 and the carrier tank 108 are emptied, and concentrated ink or carrier cannot be supplied to the circulation tank 104, the refill cartridge 114 is installed at the refill cartridge installation unit 118, and the entrance 115 of the refill cartridge 114 is connected to theink injection hole 142 or the carrier injection hole 144 of the rotary plate 146. Then, the ink or carrier in the refill cartridge 114 flows into the ink tank 106 or the carrier tank 108 through the ink supply path 110 or the carrier supply path 112, respectively. If the refill cartridge 114 is filled with compressed gas, the refill rate of the concentrated ink or carrier can be increased.

When the waste tank 120 is fully filled with waste developer, the empty refill cartridge 122 is installed at the waste refill cartridge installation unit 124, and the waste developer exhaustion pump 158 is operated. As a result, waste developer in the waste tank 120 is collected in the empty waste refill cartridge 122 through the waste developer exhaustion path 156.

Figure 3:
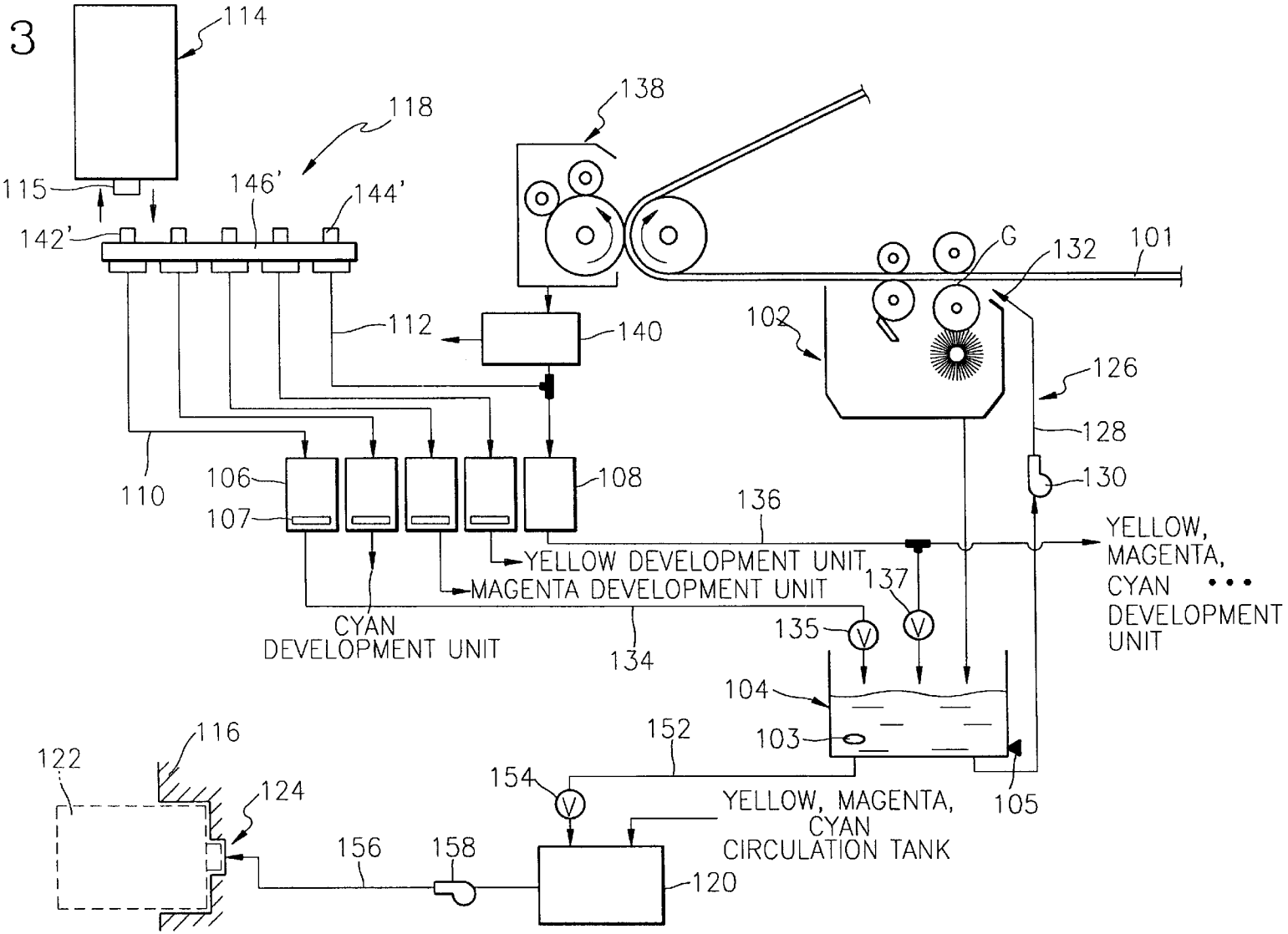
FIG. 3 is a view schematically showing the structure of an ink delivery system for a liquid electrophotographic printer according to another preferred embodiment of the present invention.

FIG. 3 shows another preferred embodiment of the present invention in which a sliding plate 146', instead ofthe rotary plate 146, is adopted as the movable plate of the refill cartridge installation unit 118. The sliding plate 146' can be moved by a rack and pinion or a lead screw (not shown) with respect to the main body 116 of the printer. Ink injection-holes 142' and acarrierinjectionhole 144' are arrayed parallel to one another in the sliding plate 146' so that the entrance 115 of the refill cartridge 114 can selectively register with the ink injection hole 142' and the carrier injection hole 144' as the sliding plate 146' reciprocates. In FIG. 3, the same reference numerals as used in FIG. 2 are used to identify identical elements having the same functions as in FIG. 2, and accordingly the description thereof is omitted.

As described above, the ink delivery system for a liquid electrophotographic printer according to the present invention has advantages as follows: first, since the ink tank and the carrier tank having functional parts are fixed inside the printer, the supply of ink and carrier is made easy by installing the refill cartridge at the refill cartridge installation unit provided at the main body of the printer to refill the ink or carrier; second, since the waste developer in the waste tank is collected in the empty waste refill cartridge, parts of the printer (such as the development unit) do not need to be disassembled to collect the waste developer, and the waste refill cartridge can be recycled; and third, manufacturing cost can be reduced by having functional parts, such as the agitator in the ink tank or the carrier tank, built into the main body of the printer, rather than in the refill cartridge.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. An ink delivery system for a liquid electrophotographic printer for supplying developer of a predetermined concentration and comprising a mixture of ink and carrierto a development unit, said system comprising:

a circulation tank containing developer supplied to said development unit;

an ink tank and a carrier tank included in a main body of said printer, said ink tank storing ink and said carrier tank storing carrier, said ink and said carrier being supplied to said circulation tank;

are fill cartridge for refilling one of said ink and said carrier through a respective supply path when one of said ink and said carrier in said ink tank and said carrier tank, respectively, is used up;

a refill cartridge installation unit to which said refill cartridge is detachably installed for supplying said one of said ink and said carrier from said installed refill cartridge to a respective one of said ink tank and said carrier tank;

a waste tank connected to said circulation tank to collect waste developer from said circulation tank; and a waste refill cartridge installation unit provided in said main body of said printer and connected to said waste tank, said waste refill cartridge installation unit being adapted to detachably receive a waste refill cartridge.

2. The system as claimed in claim 1, wherein said waste refill cartridge installation unit comprises:

a waste developer exhaustion path connected to said waste tank; and a waste developer exhaustion pump installed on said waste developer exhaustion path for exhausting the waste developer in said waste tank to said waste refill cartridge.

3. The system as claimed in claim 1, wherein said refill cartridge has a single entrance through which said one of said ink and said carrier contained in said refill cartridge is exhausted, and through which waste developer can enter said refill cartridge, and saidrefill cartridge installation unit comprises:

a movable plate having an injection hole installed therein for each respective supply path; and a driving source for moving said movable plate so as to register said single entrance with one of said injection holes.

4. The system as claimed in claim 3, wherein said driving source slides said movable plate.

5. The system as claimed in claim 3, wherein said driving source rotates said movable plate.

6. An ink delivery system for a liquid electrophotographic printer for supplying developer of a predetermined concentration and comprising a mixture of ink and carrier to a development unit, said system comprising:

a circulation tank containing developer supplied to said development unit;

an ink tank and a carrier tank included in a main body of said printer, said ink tank storing ink and said carrier tank storing carrier, said ink and said carrier being supplied to said circulation tank;

a refill cartridge for refilling one of said ink and said carrier through a respective supply path when one of said ink and said carrier in said ink tank and said carrier tank, respectively, is used up; and refill cartridge installation means to which said refill cartridge is detachably installed for supplying said one of said ink and said carrier from said installed refill cartridge to a respective one of said ink tank and said carrier tank;

wherein said refill cartridge has a single entrance through which said one of said ink and said carrier contained in said refill cartridge is exhausted, and said refill cartridge installation means comprises:

a movable plate having an injection hole for said respective sunplv path; and a driving source for moving said movable plate so as to register said single entrance with one of said injection holes.

7. The system as claimed in claim 6, wherein said driving source slides said movable plate.

8. The system as claimed in claim 6, wherein said driving source rotates said movable plate.

9. An ink delivery system for a liquid electrophotographic printer for supplying developer to a development unit and for disposing of waste developer, said system comprising:

a circulation tank containing developer supplied to said development unit;

a waste tank connected to said circulation tank to collect waste developer from said circulation tank; and waste refill cartridge installation means provided in said main body of said printer and connected to said waste tank, said waste refill cartridge installation means being adapted to detachably receive a waste refill cartridge;

wherein saidwaste refill cartridge installationmeans comprises awaste developer exhaustion path connected to said waste tank, and a waste developer exhaustion pump installed on said waste developer exhaustion path for exhausting the waste developer in said waste tank to said waste refill cartridge.

10. The system as claimed in claim 9, further comprising refill cartridge installation means to which a refill cartridge is detachably installed for supplying one of ink and carrier through a respective supply path to a circulation tank, said refill cartridge installation means comprising:

a movable plate having an injection hole installed therein for each respective supply path; and a driving source for moving said movable plate so as to register an entrance of said refill cartridge with one of said injection holes.

11. The system as claimed in claim 10, wherein said driving source slides said movable plate.

12. The system as claimed in claim 10, wherein said driving source rotates said movable plate.

13. An ink delivery system for a liquid electrophotographic printer for supplying developer comprising a mixture of ink and carrier to a development unit, said system comprising:

an ink tank and a carrier tank included in said printer, said ink tank storing ink and said carrier tank storing carrier, refill cartridge means for refilling at least one of said ink and said carrier through a respective supply path; and refill cartridge installation means to which said refill cartridge means is detachably installed for supplying said at least one of said ink and said carrier from said installed refill cartridge means to a respective one of said ink tank and said carrier tank;

wherein said refill cartridge means has at least one entrance through which said at least one of said ink and said carrier contained in said refill cartridge means is exhausted, and said refill cartridge installation means comprises:

a movable plate having at least one injection hole for said respective supply path; and a driving source for moving said movable plate so as to register said at least one entrance with said at least one injection hole.

14. The system as claimed in claim 13, wherein said driving source slides said movable plate.

15. The system as claimed in claim 13, wherein said driving source rotates said movable plate.

* * * * *